US008042690B2

(12) United States Patent
Lewis

(10) Patent No.: US 8,042,690 B2
(45) **Date of Patent: *Oct. 25, 2011**

(54) WIPER BLADE PACKAGE

(75) Inventor: Gregg S. Lewis, Middleton, WI (US)

(73) Assignee: Portage Plastics Corporation, Portage, WI (US)

( * ) Notice: Subject to any disclaimer, the term of this patent is extended or adjusted under 35 U.S.C. 154(b) by 509 days.

This patent is subject to a terminal disclaimer.

(21) Appl. No.: 11/399,930

(22) Filed: Apr. 7, 2006

(65) Prior Publication Data

US 2007/0235362 A1 Oct. 11, 2007

(51) Int. Cl.
*B65D 73/00* (2006.01)

(52) U.S. Cl. ..... 206/471; 206/470; 206/467

(58) Field of Classification Search ..... 206/349, 206/470, 471, 365, 467, 461, 463, 495, 486
See application file for complete search history.

(56) References Cited

U.S. PATENT DOCUMENTS

| | | | |
|---|---|---|---|
| 3,217,867 | A | 11/1965 | Harris |
| 3,786,982 | A | 1/1974 | Rakes et al. |
| D235,080 | S | 5/1975 | Verona |
| 4,016,972 | A | 4/1977 | Szamborski |
| 4,058,212 | A | 11/1977 | Wyslotsky |
| 4,225,077 | A | 9/1980 | Veitinger |
| D271,000 | S | 10/1983 | Rimer |
| 4,512,474 | A | 4/1985 | Harding |
| 4,576,330 | A | 3/1986 | Schepp |
| D283,489 | S | 4/1986 | Stevens |
| D288,481 | S | 2/1987 | Holewinski et al. |
| 4,739,883 | A | 4/1988 | Mohs et al. |
| D295,573 | S | 5/1988 | Williams |
| 4,807,747 | A | 2/1989 | Hadtke |
| 4,854,450 | A | 8/1989 | Fisher |
| 4,872,551 | A | 10/1989 | Theros |
| 4,899,877 | A | 2/1990 | Kiernan |
| 4,986,438 | A | 1/1991 | Borst |
| 5,027,947 | A | 7/1991 | Rieghart |
| 5,046,659 | A | 9/1991 | Warburton |
| 5,060,814 | A | 10/1991 | Oglesbee |
| 5,105,942 | A | 4/1992 | van Veen et al. |
| 5,129,516 | A | 7/1992 | Theros |
| 5,154,293 | A | 10/1992 | Gould |
| 5,156,267 | A | 10/1992 | Yates, Jr. et al. |
| D336,040 | S | 6/1993 | Pahilippe |
| 5,293,993 | A | 3/1994 | Yates et al. |
| D347,280 | S | 5/1994 | Herrington et al. |
| 5,353,929 | A | 10/1994 | Foster |

(Continued)

FOREIGN PATENT DOCUMENTS

| | | |
|---|---|---|
| DE | 2326093 | 12/1974 |

(Continued)

*Primary Examiner* — J. Gregory Pickett
*Assistant Examiner* — Andrew Perreault
(74) *Attorney, Agent, or Firm* — Boyle Fredrickson, S.C.

(57) ABSTRACT

A beam-type wiper blade reclosable package that includes a pair of package halves joined by an elongate compliant joint that preferably enables one of the package halves to function as a cover that can be closed over a base that includes a curved beam-type wiper blade compartment formed therein. The compartment includes a wiper blade beam or backbone seat and a wiping blade element land, an adapter clearance recess defining a lip that facilitates package opening and closing and wiper blade removal facilitating pockets. The compliant joint preferably is a living hinge of double fold construction that serves to strengthen the package when closed.

8 Claims, 8 Drawing Sheets

U.S. PATENT DOCUMENTS

| | | | | |
|---|---|---|---|---|
| 5,358,113 | A | 10/1994 | Hellenbrand | |
| 5,358,134 | A | 10/1994 | Ripley et al. | |
| 5,370,226 | A | 12/1994 | Gollobin et al. | |
| 5,379,896 | A | 1/1995 | Snow et al. | |
| D357,626 | S | 4/1995 | Snow et al. | |
| 5,411,140 | A | 5/1995 | Byer | |
| D360,132 | S | 7/1995 | Ripley | |
| 5,447,232 | A | 9/1995 | Chow | |
| D368,027 | S | 3/1996 | Baker | |
| D368,028 | S | 3/1996 | Baker | |
| D368,029 | S | 3/1996 | Baker | |
| 5,540,324 | A | 7/1996 | Knapp | |
| 5,566,828 | A | 10/1996 | Claes et al. | |
| 5,584,408 | A | 12/1996 | Orkisz | |
| D395,234 | S | 6/1998 | Shida et al. | |
| 5,772,031 | A | 6/1998 | Landis | |
| 5,865,307 | A | 2/1999 | Friedman | |
| D406,755 | S | 3/1999 | Garganese | |
| 5,899,334 | A | 5/1999 | Domerchie et al. | |
| 6,041,933 | A | 3/2000 | Baker | |
| 6,070,723 | A | 6/2000 | Lewis | |
| D434,226 | S | 11/2000 | Strohmeier | |
| 6,244,444 | B1 | 6/2001 | Jacobus et al. | |
| 6,247,590 | B1 * | 6/2001 | Baker | 206/467 |
| 6,550,096 | B1 | 4/2003 | Stewart et al. | |
| 6,625,955 | B2 | 9/2003 | Aylward | |
| 6,675,433 | B1 | 1/2004 | Stewart et al. | |
| 6,691,898 | B2 | 2/2004 | Hurray et al. | |
| 6,766,906 | B2 | 7/2004 | Charng | |
| 6,779,661 | B1 | 8/2004 | Kotlarski | |
| 6,813,923 | B2 | 11/2004 | Jones et al. | |
| 5,899,334 | C1 | 12/2004 | Dommerchie et al. | |
| 6,836,925 | B1 | 1/2005 | Swanepoel | |
| 7,258,233 | B2 * | 8/2007 | Lee | 206/470 |
| 7,337,900 | B2 * | 3/2008 | Reiber et al. | 206/349 |
| 2003/0062284 | A1 | 4/2003 | Charng | |
| 2004/0045858 | A1 | 3/2004 | Harrold | |
| 2004/0131804 | A1 | 7/2004 | Baker | |
| 2005/0082185 | A1 * | 4/2005 | Lee | 206/471 |
| 2005/0252812 | A1 | 11/2005 | Lewis | |
| 2006/0006090 | A1 * | 1/2006 | Charng | 206/461 |
| 2006/0081493 | A1 * | 4/2006 | Park | 206/470 |
| 2007/0017842 | A1 | 1/2007 | Clamagirand et al. | |

FOREIGN PATENT DOCUMENTS

| | | |
|---|---|---|
| DE | 199 51 971 | 5/2001 |
| DE | 10224431 | 12/2003 |
| EP | 0594451 | 4/1994 |
| FR | 2843368 | 2/2004 |
| GB | 2190066 | 11/1987 |
| WO | WO 03/101796 | 12/2003 |
| WO | WO 2005/026005 | 3/2005 |

* cited by examiner

WIPER BLADE PACKAGE

FIELD OF THE INVENTION

The present invention is directed to a wiper blade package arrangement and more particularly to a wiper blade package that releasably holds a wiper blade that preferably is of beam-type construction.

BACKGROUND OF THE INVENTION

Beam-type windshield or windscreen wiper blades are growing in popularity throughout the United States and the rest of the world. Beam-type wiper blades have an elongate beam "backbone" that is curved along its length. They also have a rubber wiper element attached to one side of the beam and an adapter, used for releasably mounting the wiper blade to a vehicle, attached to the beam, which extends outwardly from its other side. Examples of beam-type wiper blades are disclosed in U.S. Pat. Nos. 6,836,925, 6,813,923, and 6,550,096.

The curved beam helps ensure more constant and even pressure is applied along the entire windshield, providing a smoother, more consistent wipe. While conventional articulating framework wiper blades typically have somewhere around six or eight pressure points, beam-type wiper blades essentially have an infinite number of pressure points, helping to ensure the wiper element is urged against the windshield with substantially continuous pressure along substantially the entire length of the blade. A curved beam is also better able to conform to the curved contour of just about any vehicle windshield, which further ensures a smoother, more consistent wiping action.

During operation, each wiper blade is attached to an arm that moves back and forth across part of a windshield of a vehicle. The wiper element rides in concert along the surface of the windshield, essentially functioning as a squeegee to urge water in its path off the windshield.

Packaging such a beam-type windshield wiper blade poses unique challenges as compared to conventional wiper blades because of its curved beam shape and because the wiper element is directly attached to the beam. Thus, a critical challenge relates to protecting the wiper element as well as the beam. Due to the curvature of the beam and the arrangement of the wiper element, the end of the wiper element can become warped or distorted over time if the blade is not properly supported. Should this happen, part or all of the wiper element will make poor contact with the windshield, which can cause undesirable streaking during wiper operation. This warpage or distortion can also extend along part of the squeegee edge of the wiper element, exacerbating these problems. If too great, it can undesirably result in such warped or distorted wiper blades being returned to the store for refund.

Accordingly, it would be desirable and advantageous to provide packaging for a beam-type wiper blade that protects the blade while being of economical, durable, resilient and reclosable construction.

SUMMARY OF THE INVENTION

The present invention is directed to a beam-type wiper blade package that has a pair of package halves formed of a single sheet of material. One package half defines a cover that fits over and encompasses a base in which is formed a curved beam-type wiper blade compartment. The wiper blade compartment preferably includes a beam or backbone seat for receiving and supporting along an edge a beam or backbone of a beam-type wiper blade. The compartment preferably also includes a wiper element land upon which an elastomeric wiper element of the beam-type wiper blade is safely and protectively supported.

The package includes at least a plurality of releasable latching arrangements, each of which releasably latches a portion of the cover to the base. In a preferred embodiment, each releasable latching arrangement is a snap that includes a boss that is releasably received in a pocket of a snap receiver. A friction fit, interference fit, e.g. snap fit, or the like is provided therebetween to releasably retain the cover in a closed position against the base.

In one preferred embodiment, the package has at least a plurality of pairs of snaps with at least one snap disposed on one side of the wiper blade compartment and at least one other snap disposed on the other side of the wiper blade compartment. For example, in one preferred embodiment, a plurality of snaps are substantially equidistantly spaced from a transversely extending package centerline and at least one snap is disposed on or along the centerline such that the at least one snap can straddle the centerline.

The package halves are joined by an elongate compliant joint that preferably is a living hinge. In one preferred embodiment, the living hinge is of dual fold construction having a pair of hinge folds joined by hinge webbing that preferably defines a fold line about which the cover pivots when closing it against the base. Such a dual living hinge fold construction also helps strengthen and stiffen the package when the cover is closed because each hinge fold forms a stiffening tube or the like when closed.

The beam-type wiper beam cradle can be interrupted or include at least one wiper blade adapter clearance recess formed in the base. Such a clearance recess can be defined, at least in part, by a lip that can be used to manually open the cover. If desired, the cover can be formed with such a clearance recess. The base preferably has at least one wiper blade removal depression that facilitates manual removal of a seated beam-type wiper blade.

Objects, features and advantages of the present invention include providing a wiper blade package that is aesthetically attractive; that is of economical manufacture, that is durable, that is lightweight and low cost to ship, that is strong, that is easy to make and use, that is more versatile and adaptable, and which is durable, robust and reliable.

Numerous other aspects, features and advantages of the present invention will be made apparent from the following detailed description taken together with the drawing figures.

BRIEF DESCRIPTION OF THE DRAWINGS

The drawings illustrate the best mode currently contemplated of practicing the present invention. One or more preferred exemplary embodiments of the invention are illustrated in the accompanying drawings in which like reference numerals represent like parts throughout and in which.

Figure 1:
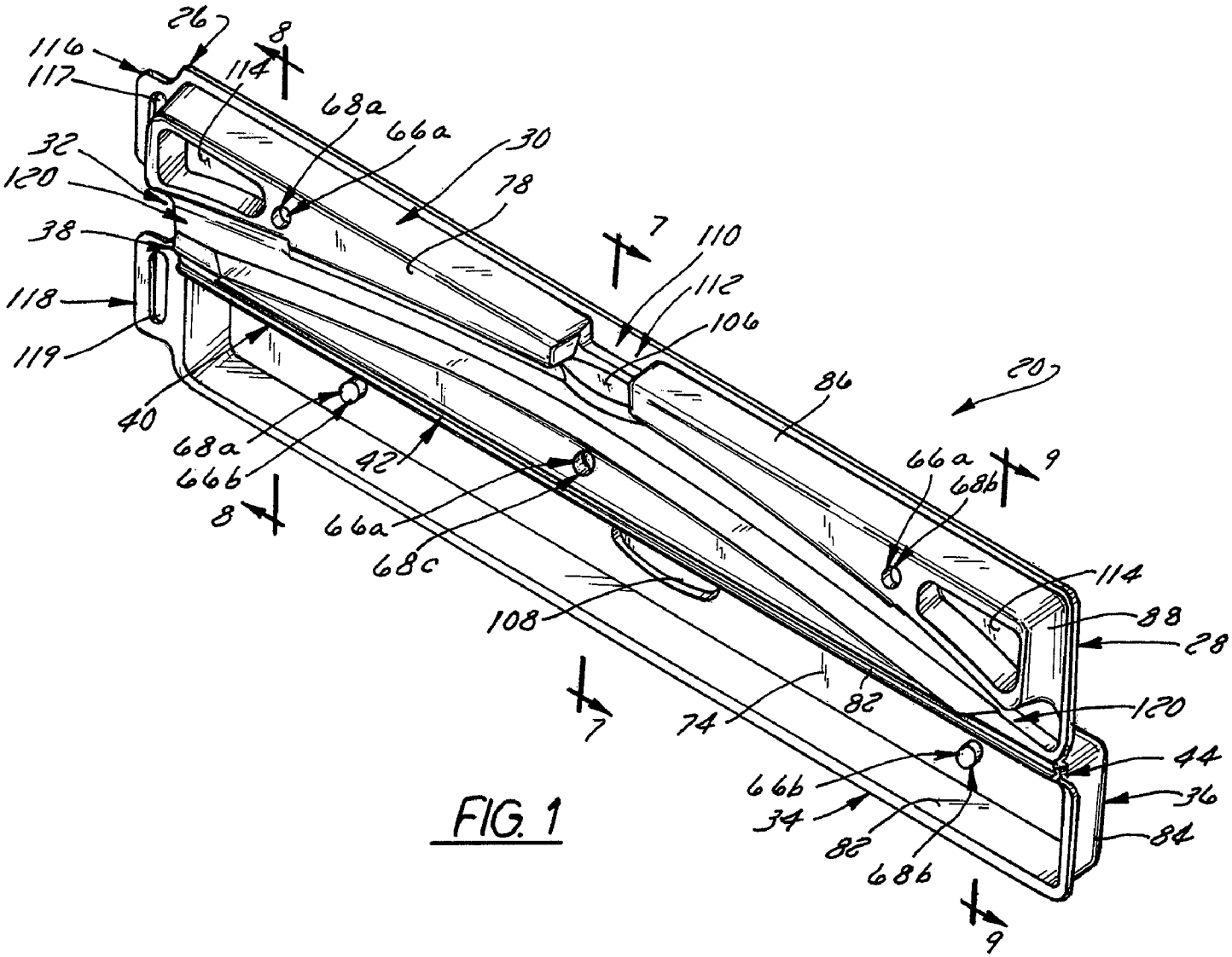
FIG. 1 is a top perspective view of a beam type wiper blade package constructed in accordance with the present invention.

Before explaining one or more embodiments of the invention in detail, it is to be understood that the invention is not limited in its application to the details of construction and the arrangement of the components set forth in the following description or illustrated in the drawings. The invention is capable of other embodiments, which can be practiced or carried out in various ways. Also, it is to be understood that the phraseology and terminology employed herein is for the purpose of description and should not be regarded as limiting.

DETAILED DESCRIPTION OF AT LEAST ONE PREFERRED EMBODIMENT

Figure 2:
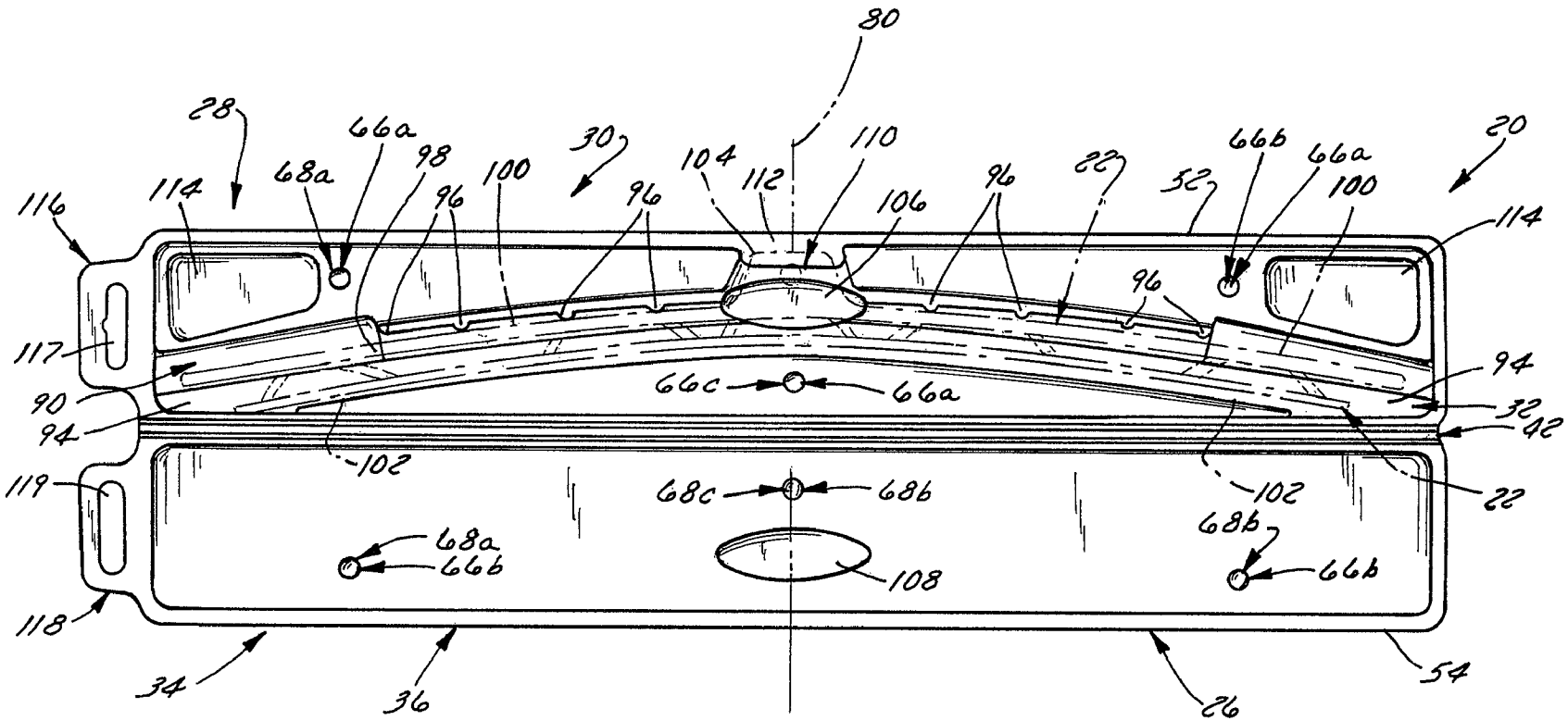
FIG. 2 is a top plan view of the beam type wiper blade package.
Figure 3:
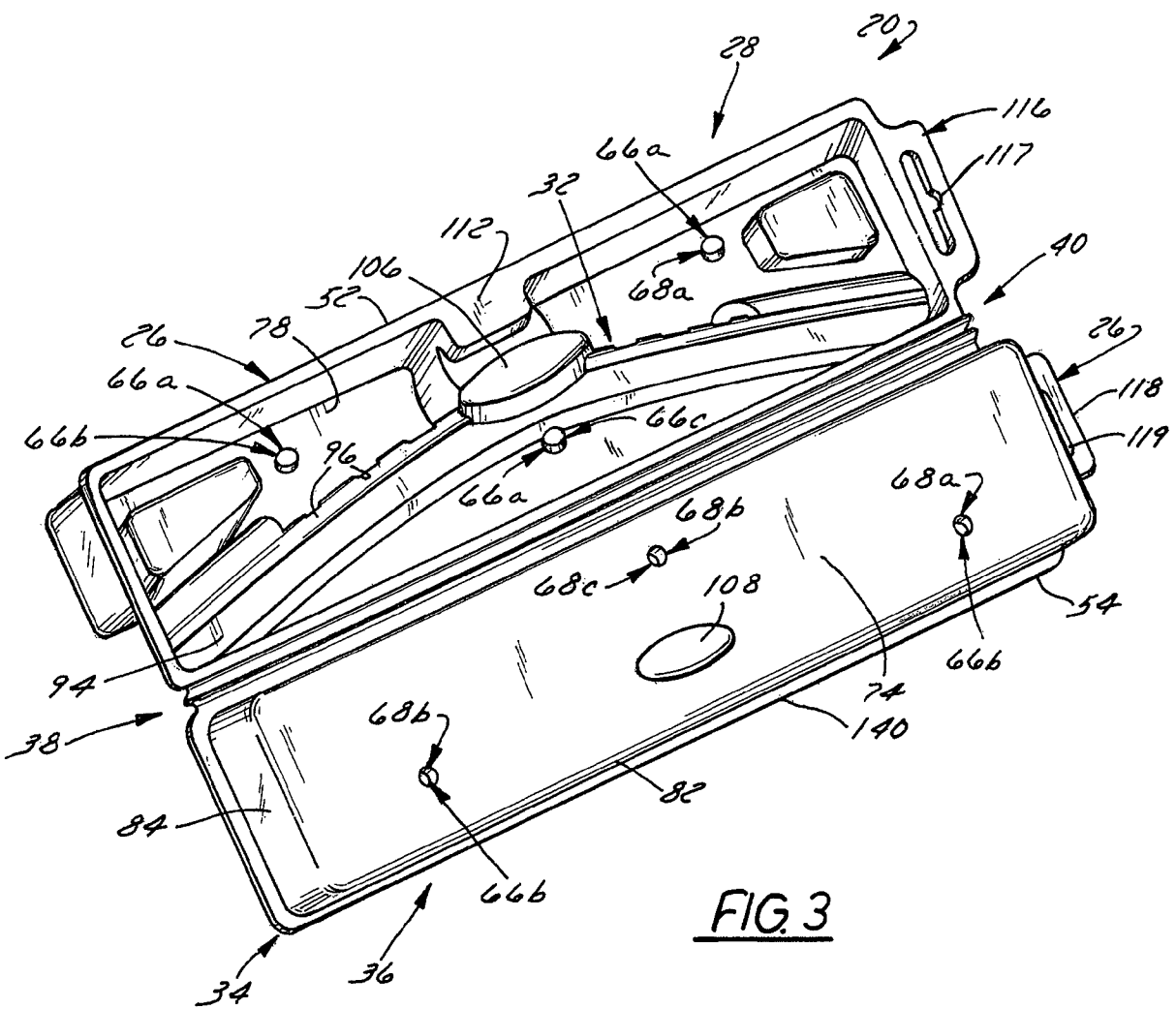
FIG. 3 is a bottom perspective view of the beam type wiper blade package.
Figure 5:
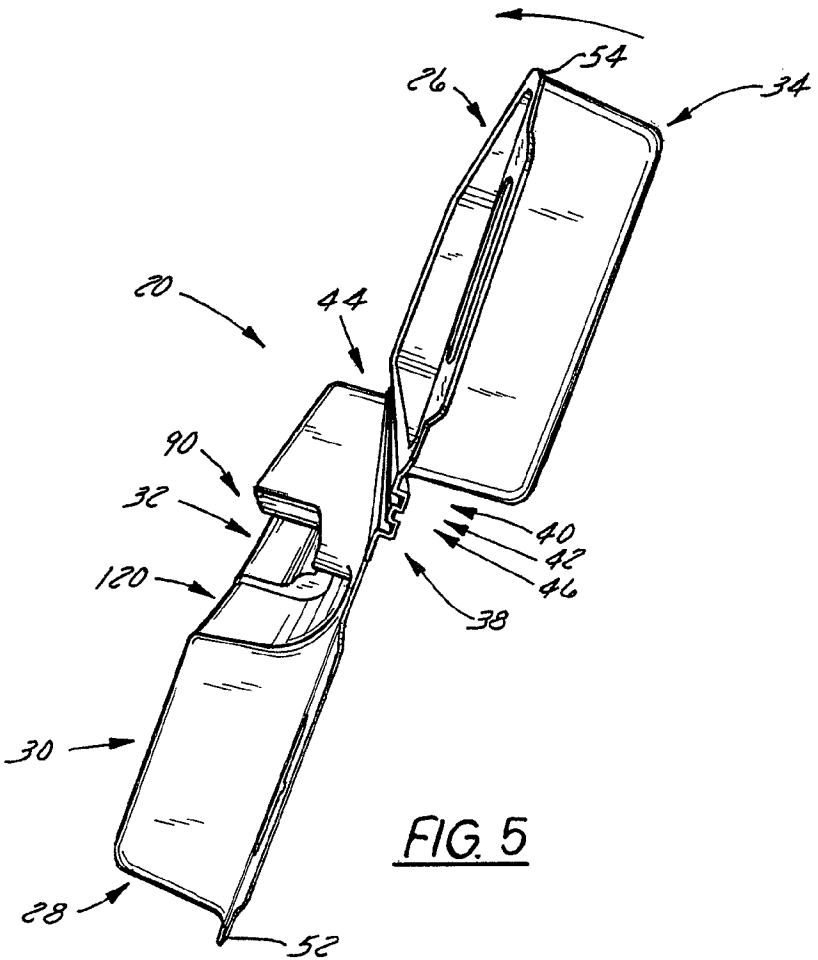
FIG. 5 is an end perspective view of the beam type wiper blade package.
Figure 4:
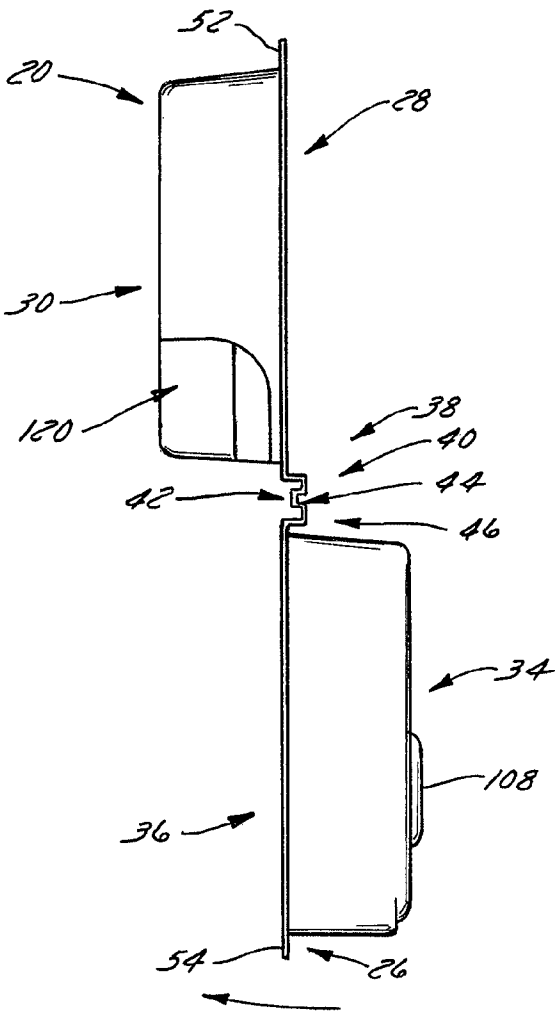
FIG. 4 is an end elevation view of the beam type wiper blade package.
Figure 10:
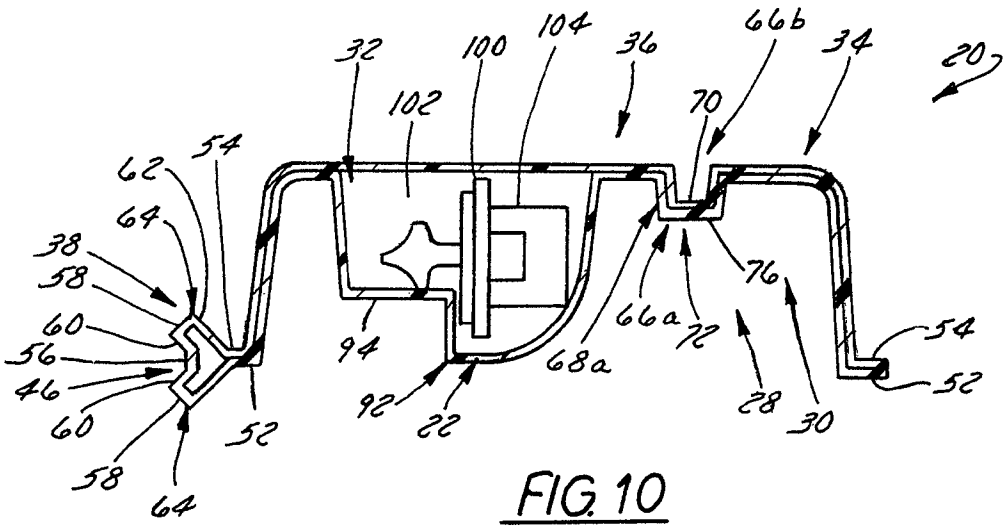
FIG. 10 depicts the cross sectional view of FIG. 8 when the package is closed.

FIGS. 1-10 illustrate a preferred embodiment of a reclosable wiper blade package 20 that is constructed and arranged in accordance with the invention to releasably retain a curved beam-type windshield wiper blade 22 (FIGS. 2 and 10). The package 20 is advantageously reclosable, is of one-piece, unitary and homogenous construction, and is of a clamshell configuration. If desired, the package 20 preferably is capable of use as or otherwise configurable as a package nest that is, in turn, received inside another package, such as the outer package 24 shown in FIGS. 10 and 11.

The package 20 is formed of a single sheet 26 having a first sheet segment or package half 28 that includes a base 30 that is three dimensionally contoured so as to define a wiper blade receiving compartment 32 that is curvilinear along its lengthwise extent and which preferably is curved in a complementary manner so as to accept a particular curved beam-type wiper blade or beam-type wiper blade assembly for which it is intended. The sheet 26 from which the package 20 is formed also has a second sheet segment or package half 34 that is three dimensionally contoured in a manner that forms a cover 36 and that is also constructed and arranged in a manner so as to facilitate releasable engagement of the first package half 28 to close the package 20. In the preferred embodiment shown in FIGS. 1-9, the first package half 28 is also constructed and arranged in a manner so as to facilitate releasable engagement of the second package half 34 such that mutual engagement occurs when the package 20 is closed.

A compliant joint 38 that preferably is a hinge 40, such as a living hinge 42, joins the package halves 28 and 34 in manner that permits at least one package half to be pivotally or rotatively displaceable relative to and toward the other package half. For example, in a preferred embodiment, the hinge 40 is a living hinge 42 that is located between the package halves 28 and 34 permitting one package half 34 to be folded toward and over the other package half 28. Force can be applied to either one of the package halves 28 or 34 or substantially simultaneously to both package halves 28 and 34 to urge them together. During application of force, at least part of the hinge 40 acts as a fold line 44 between the package halves 28 and 34. Upon application of a certain amount of force, the package halves 28 and 34 engage each other. When engagement reaches a certain point, such as after the application of sufficient force beyond that needed for the package halves 28 and 34 to begin engaging each other, positive engagement is such that the package 20 remains closed after the applied force is removed.

Depending on the construction of the hinge 40, the fold line 44 can actually encompass a relatively narrow fold region or band that extends substantially the length of the hinge 40. While a hinge 40 that preferably is a living hinge 44 of integral construction is used, another type of compliant joint that facilitates folding one or both package halves 28 and 34 in such a manner that enables them to engage can be used in instances where such a hinge is not required. For example, if desired, a compliant joint that is or includes a pivoting arrangement (not shown) can be used that is configured to facilitate the folding of the package halves 28 and 34 in a manner that enables them to be releasably closed. However, in the currently preferred embodiment of the beam-type wiper blade package 20 shown in FIGS. 1-9, the compliant joint 38 is a living hinge 42 that defines at least one substantially straight fold line 44 that extends along substantially the entire length of the hinge. In a preferred embodiment, fold line 44 extends along the entire length of the hinge.

FIGS. 4-10 illustrate a preferred embodiment of a living hinge 42. The living hinge 42 preferably is a dual-fold living hinge 46 having a first hinge fold 48 extending along one package half 28 and a second hinge fold 50 extending along the other package half 34. Each hinge fold 48 and 50 preferably is attached to its respective package half by a flange 52 and 54. Each these flanges 52 and 54 preferably extend continuously substantially the length of the hinge and, if desired, can extend substantially the length of the package 20. In the preferred package embodiment shown in FIGS. 1-9, each of these flanges 52 and 54 also respectively extend about the periphery of its corresponding package half.

Living hinge webbing 56 extends between the hinge folds 48 and 50, defining a primary fold region or fold line 44 of the hinge 42. However, depending on factors such as sheet thickness, required positive engagement force, the fit between the beam-type wiper blade and the package halves, etc., one or both flanges 52 and 54 can also serve as an auxiliary or secondary fold region or fold line in addition to or along with the primary fold region or fold line 44. As will be made apparent in more detail below, in a preferred embodiment, the flanges 52 and 54, to the extent either serves as an auxiliary or secondary fold region or fold line, preferably are capable of doing so temporarily during closing of the package 20 and preferably only to the extent needed to accomplish package half engagement and package closing.

Figure 8:
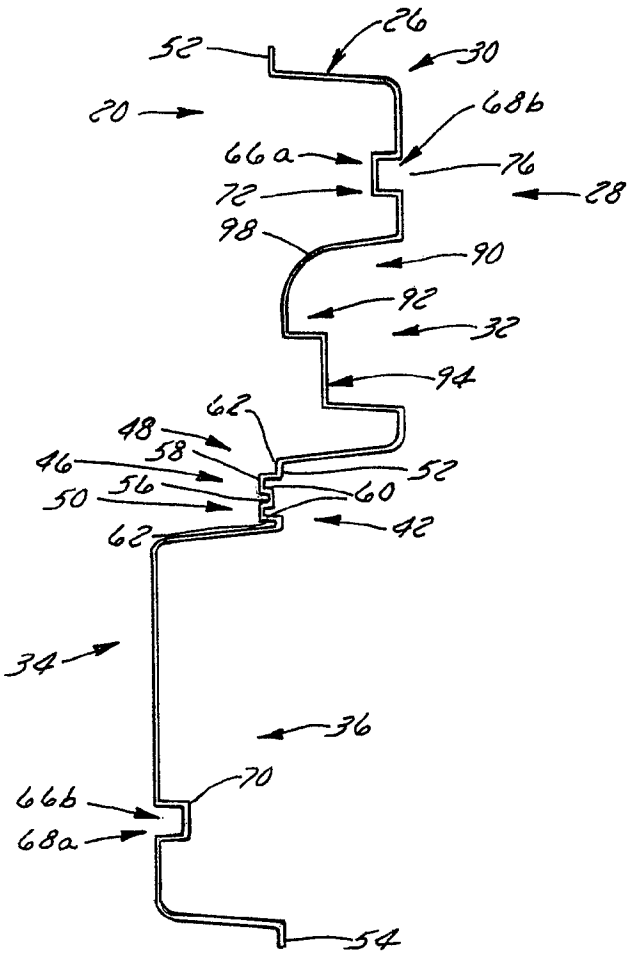
FIG. 8 is a cross sectional cut taken along 8-8 of FIG. 1.
Figure 7:
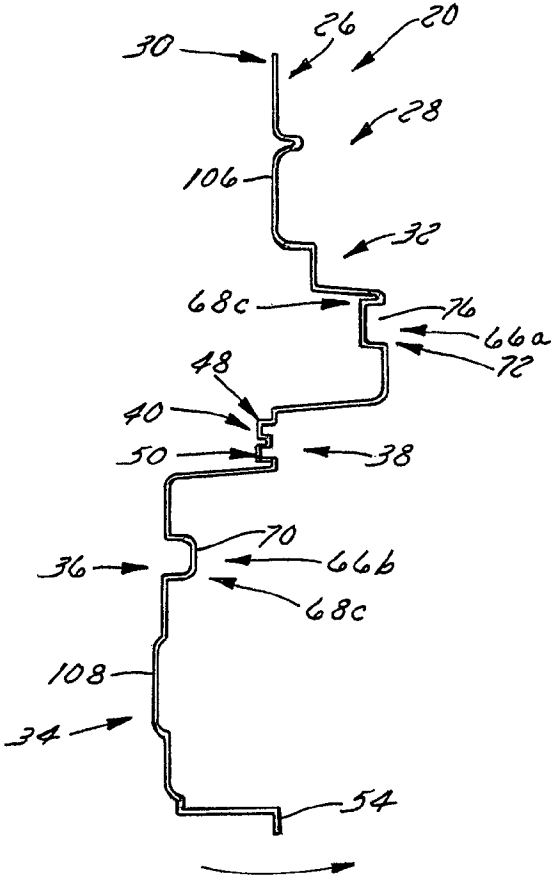
FIG. 7 is a cross sectional cut taken along 7-7 of FIG. 1.
Figure 9:
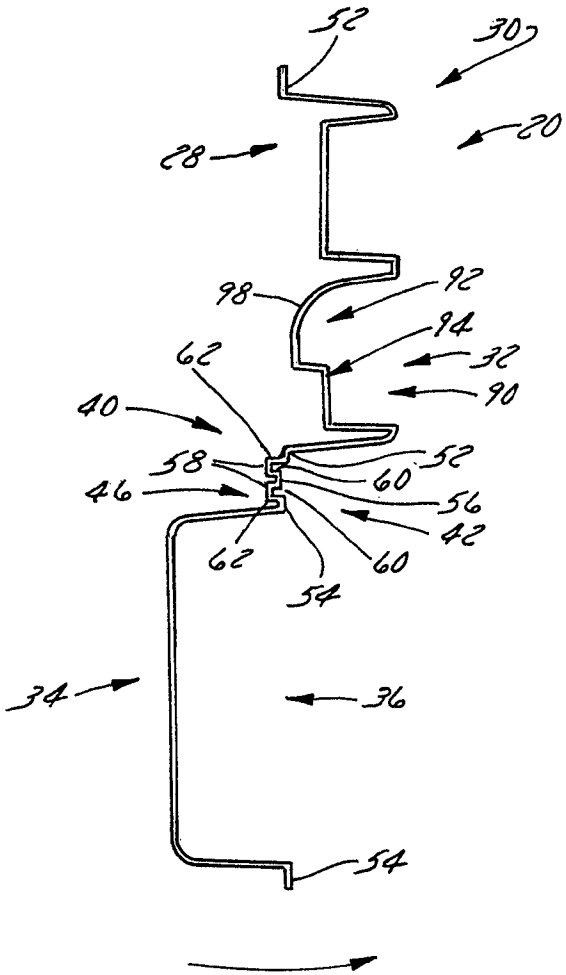
FIG. 9 is a cross sectional cut taken along 9-9 of FIG. 1.

With specific reference to FIGS. 8-10, each hinge fold 48 and 50 preferably is of generally U-shaped cross section such that the hinge folds 48 and 50 cooperate with one another to advantageously help increase the stiffness and structural rigidity of the package 20, particularly when closed. Each hinge fold 48 and 50 has a back webbing segment 58 that is connected at a substantially right angle to each one of a pair of adjoining legs 60 and 62. One of the hinge fold legs 60 of each hinge fold 48 and 50 preferably is connected at a substantially right angle to the living hinge webbing 56 and the other one of the hinge fold legs 62 of each hinge fold 48 and 50 preferably is connected at a substantially right angle to a corresponding package half flange 52 or 54.

When the package 20 is closed, such as is depicted in FIG. 10, the hinge folds 48 and 50 are capable of abutting to the extent needed and, in any event, hinge folds 48 and 50 each preferably form an elongate strengthening tube 64. Each such strengthening tube 64 helps increase package stiffness and structural, e.g., torsional, rigidity. In the preferred embodiment illustrated in FIG. 10, each strengthening tube 64 has a generally triangular cross sectional shape, but one or both hinge folds 48 and 50 can be configured so as to impart a different cross sectional strengthening tube shape. For example, depending on the configuration of one or both hinge folds 48 and 50, each resultant strengthening tube 64 can instead have a generally rectangular, generally circular, or generally oval cross sectional shape (not shown). In one preferred embodiment that is not shown, when the package 20 is closed, each hinge fold 48 and 50 forms a strengthening tube 64 having a lobe or leaf shape (not shown) such that each tube 64 has a folium cross sectional shape (not shown). This can and typically does result from deflection of the package sheet material bending and thereby rounding at least somewhat one or more of the generally right-angled corners between hinge fold surfaces 56, 58, 60, and 62. Where a pair of such strengthening tubes result, the tube pair preferably is of bifoliate cross sectional shape (not shown).

With continued reference to FIGS. 7-10, during package closing, the package halves 28 and 34 preferably fold about the living hinge webbing 56 causing at least some deformation of each hinge fold 48 and 50 to occur, distorting each hinge fold 48 and 50 into a generally triangular, rectangular, oval or lobe-shaped cross sectional shape. As a result, when the package 20 is closed, each hinge fold 48 and 50 defines an elongate generally triangular, rectangular, oval or lobe-shaped strengthening tube 64 that extends substantially the length of the hinge 40 helping to stiffen and structurally rigidify, e.g. resist twisting or torsion, the closed package 20. The width of each back webbing segment 58 of each hinge fold 48 and 50 along with the width of each leg 60 and 62 preferably are chosen to permit package 20 closure without clashing occurring between its legs, back webbing segment 58 and/or living hinge webbing. This produces a living hinge type compliant joint 38 having one or more of the above-discussed advantages but which also advantageously has a minimum of clash or interference induced package spring-back. Minimizing this type of spring-back is advantageous because it reduces the likelihood and preferably substantially completely prevents the package halves 28 and 34 from inadvertently disengaging from one another and popping the package 20 open after the package 20 has been closed.

To releasably retain the package in a closed condition, such as like the package 20 depicted in FIG. 10, the package 20 has a plurality of spaced apart releasable latching arrangements 66. With continued reference to FIGS. 1-9, each releasable latching arrangement 66 is identified with reference numeral 66*a*, which represents latching structure of the releasable latching arrangement 66 that is preferably integrally formed in the package base 30 and reference numeral 66*b*, which represents additional latching structure of the releasable latching arrangement 66 that preferably is integrally formed in the package cover 36. As is discussed in more detail below, these latching structures 66*a* and 66*b* of the releasable latching arrangements 66 depicted in FIGS. 1-10 preferably are of complementary construction and constructed and arranged so as to cooperate when the package 20 is being closed to facilitate package closure as well as to facilitate releasable engagement when the package 20 is closed.

In the preferred embodiment shown in FIGS. 1-10, each releasable latching arrangement 66 is a snap 68 that includes a boss 70 that is releasably receivable in a receiver 72. The boss 70 of each snap 68 preferably is an outwardly projecting protrusion of generally circular cross section that extends outwardly from an outer or top surface of the cover 36 or the base 30. The receiver 72 of each snap 68 preferably is a pocket 76 formed in an outer or top surface of the base 30 or the cover 36. For example, in the preferred embodiment shown in FIGS. 1-10, the boss 72 of each snap 68 projects from a top surface 74 of the cover 36 and the boss-receiving pocket 76 of each snap 68 projects from a top surface 78 of the base 30.

A suitable fit, such as a tight fit, an interference fit, or the like, is provided between the boss 70 of each snap 68 and its corresponding pocket 76, which helps prevent unintended disengagement. For example, the outer diameter of the boss 70 of each snap 68 preferably is the same as or slightly larger than the inner diameter of the receiver pocket 76 and is sized in a manner permitting its releasable receipt of the boss 70, which preferably results in tight frictional engagement therebetween when the cover 36 is closed.

In the preferred package embodiment shown in FIGS. 1-10, the package 20 has a plurality of pairs, i.e., at least three, of snaps 68*a*, 68*b* and 68*c* with at least one snap 68*a* and 68*b* being located on one side of the beam-type wiper blade receiving compartment 32 and at least one snap 68*c* being located on the other side of the compartment 32. At least one of the snaps 68*a* and 68*b* is located outwardly of the compartment 32 on one side of the compartment 32 such that it is disposed between the compartment 32 and an outer edge of the package 20 lying opposite the hinge 40. At least one of the other snaps 68*c* is located outwardly and on the opposite side of the compartment 32 such that it is disposed between the compartment 32 and the hinge 40.

In the preferred package embodiment depicted in FIGS. 1-10, a pair of the snaps 68*a* and 68*b* are located toward the side of the package 20 adjacent or alongside its outer edge that lies opposite and generally parallel to the hinge 40. With specific reference to FIG. 2, these snaps 68*a* and 68*b* preferably are spaced apart from each other such that each is spaced a substantially equal distance from a centerline 80 (in phantom in FIG. 2) bisecting the package 20 substantially in half along its lengthwise direction. In the preferred package embodiment depicted in FIGS. 1-10, only a single snap 68*c* is located toward the side of the package 20 adjacent or alongside the hinge 40. This snap 68*c* preferably is disposed on the centerline 80 shown in phantom in FIG. 2. For example, as is shown in FIG. 2, snap 66*c* is disposed substantially on the centerline 80 such that it preferably straddles the centerline 80.

The arrangement and spacing of the snaps 68*a*, 68*b* and 68*c* helps ensure that the latching force opposing disengagement of the package halves 28 and 34 when the package 20 is closed is advantageously more uniformly spread about the package 20. This makes it easier for such a package 20 to be manually opened, e.g. such as by a customer, and helps ensure that the magnitude of unlatching force that is required to be applied to open the package 20 is consistent from one package 20 to another. The advantageous location of these snaps 68*a*, 68*b* and 68*c* also helps keep the cover 36 of the top package half 34 relatively snugly seated over and on the base 30 of the bottom package half 28.

This in turn helps strengthen the package 20 because the cover 36 has outturned or down-turned sidewalls 82 and endwalls 84 extending outwardly from the cover top surface 74 that bound the periphery of corresponding outturned or down-turned sidewalls 86 and endwalls 88 extending outwardly from the top surface 78 of the base 30 thereby preventing the base sidewalls 86 and 88 and the base 30 from buckling, oil-canning, folding or otherwise bending, e.g., splaying, inwardly or outwardly. The snaps 68*a*, 68*b* and 68*c* along with the cover sidewalls 82 and 84 and the base sidewalls 86 and 88 beneficially cooperate to produce a package 20 constructed in accordance with the invention having high structural rigidity, high crush strength, high stiffness and high strength such that the package 20 is rugged, durable and versatile as it can be stacked after filling in shipping packaging (not shown) along with dozens of other packages 20, transported via truck, rail, lake vessel, and sea vessel, all without failing or inadvertently popping open.

The top surface 78 of the base 30 preferably is complementarily contoured or shaped relative to the top surface 74 of the cover 36 such that they abut when the cover 36 is closed over the base 30. For example, as is shown in FIGS. 1-10, the top surface 78 of the base 30 and the top surface 74 of the cover 36 are generally planar along a substantial amount of their surface area thereby creating a large region where the two surfaces 74 and 78 mate in abutment (FIG. 10). Where these surfaces are substantially planar along a majority of their surface area and generally parallel with an imaginary plane along which the bottom flanges 52 and 54 preferably reside, the package 20, when closed, is of generally rectangular cross section along its transverse and lengthwise directions. This advantageously produces a package 20 that is of relatively compact construction, minimizes the volume the package occupies beyond that simply necessary to house the wiper blade 22, is easy to stack and put in larger packaging, e.g. shipping packaging (not shown), and the like.

Figure 6:
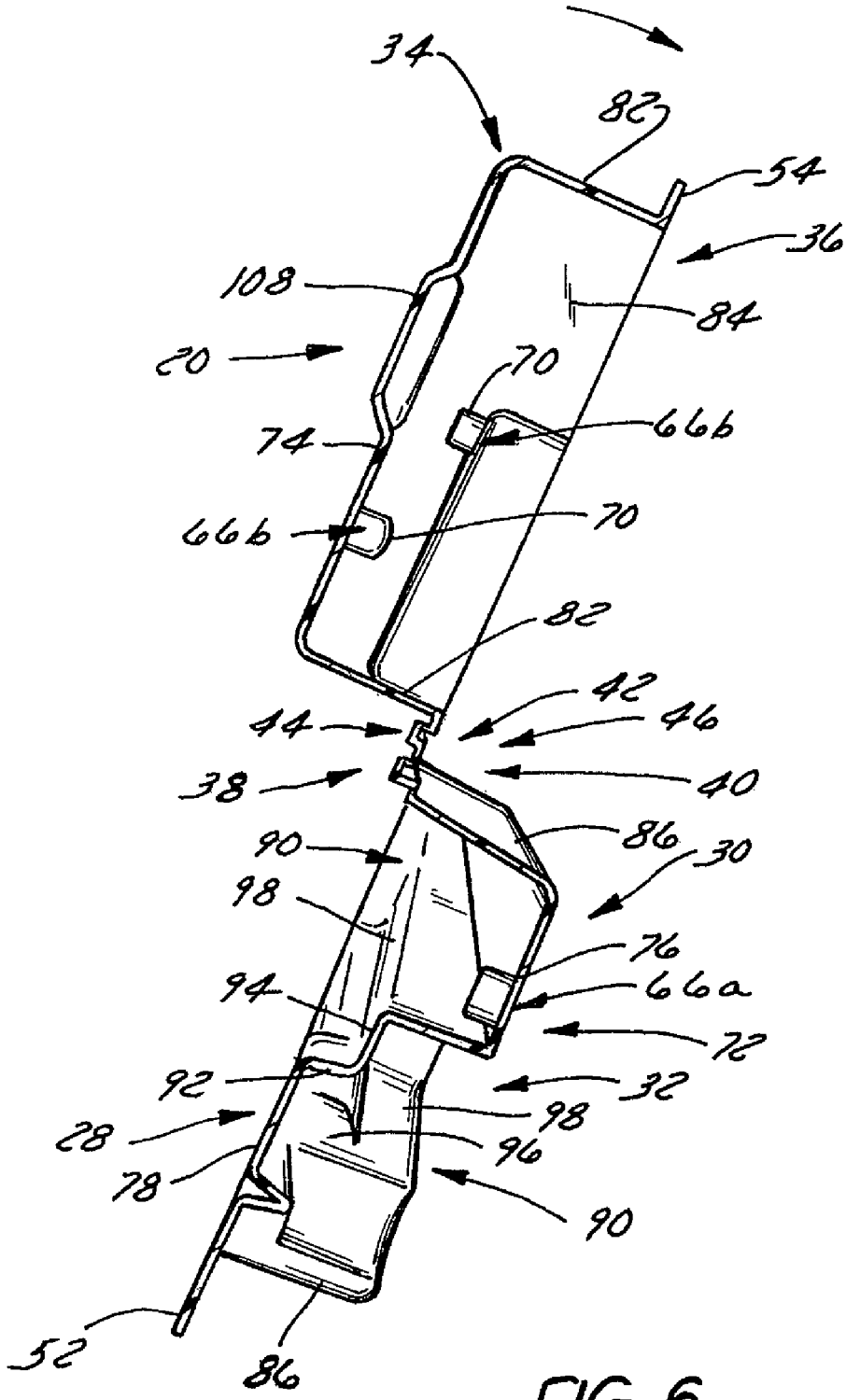
FIG. 6 is a perspective cross section end view of the beam type wiper blade package.

With specific reference to FIGS. 2, and 6-10, the wiper blade receiving compartment 32 is curved along its lengthwise extent. For example, in one preferred embodiment, the compartment 32 preferably has a radius of curvature at all points along its length that need not necessarily be uniform or the same magnitude along the entire length. The compartment 32 includes a beam-type wiper blade cradle 90 that has a wiper blade beam or backbone receiving seat 92 and a wiper element land 94. As is best shown in FIG. 6, at least a plurality of pairs of spaced apart locator tabs 96 project outwardly from an inwardly facing sidewall 98 defining an outer wall of the cradle 90 helps position a wiper blade 22 (FIGS. 2 and 10) during packaging so it quickly and easily seats in the cradle 90. The outer cradle wall 98 preferably is of curved cross section with it curved so as to slope toward the beam receiving seat 92 such that it can help reseat the wiper blade 22 should it get knocked loose and become unseated for some reason.

As is shown in FIGS. 2 and 10, a beam-type wiper blade 22 is received in the beam-type wiper blade cradle 90 with its beam or backbone 100 received in the seat 92 and at least part of one side of the wiping element 102 supported on the land 94. When the cover 36 is closed, it forms an enclosure with the base 30 that protects and secures the wiper blade 22 while advantageously preventing damage for happening to the beam 100 as well as to the wiping element 102. Another example of such a beam-type wiper blade of curved or precurved construction for which a package 20 constructed in accordance with the invention is well suited is disclosed in European Patent Specification Publication No. EP 0 594 451 B1, the entire disclosure of which is expressly incorporated by reference herein To provide clearance to accommodate a wiper blade 22 equipped with an adapter or a wiper arm mount 104, the wiper blade cradle 90 preferably includes an integrally formed adapter clearance recess 106. Depending on adapter size and shape, the cover 36 can also be formed with an outwardly extending adapter clearance recess 108, e.g., bubble, where it is needed to prevent such an adapter 104 from preventing the cover 36 from completely closing. While both adapter clearance recesses 106 and 108 are oval in shape and oriented so as to overlie one another when the cover 36 is closed, if desired another suitable clearance recess shape can be used.

To accommodate a wiper blade adapter 104 having a relatively large height or extent, such as is the case with the adapter 104 depicted in FIG. 2, a correspondingly sized clearance recess, such as clearance channel 110, can be formed in the package base 30. Such a clearance channel 110 can be configured so as to extend outwardly all the way to the outer edge of the base 30, such as in the manner shown in FIG. 2, so as to interrupt the base 30 preferably along the package centerline 80. Such an adapter clearance channel 110 can be employed instead of or in addition to the adjacent oval clearance recess 106 formed in the base 30.

In the preferred beam-type wiper blade package embodiment shown in FIGS. 1-10, where the clearance channel 110 extends outwardly all the way to the outer edge of the base 30, it preferably defines a lip that is much wider than flange 52 to make it easy for a person wishing to open the package 20 to grasp the lip 112 and urge the base 30 and cover 36 into separating from one another. For example, where a person desires to open the package 20, the lip 112 of the base 30 and the flange 54 of the cover 36 are manually engaged, such as by being grasped or the like, and force is applied urging, e.g., prying, the base and cover apart. When a sufficient amount of force is applied that breaks the positive engagement of the snaps 68*a*, 68*b* and 68*c*, the boss 70 of each snap displaces free of its corresponding pocket 76 thereby also disengaging it from the pocket. When each one of the snaps 68*a*, 68*b* and 68*c* become unsnapped in this manner, the cover 36 is easily pivoted away from the base 30.

The compartment 32 preferably is sufficiently recessed such that the cover 36 can be easily closed over the compartment 32 with a beam-type wiper blade 22 received in the compartment 32. To help releasably but yet securely retain a beam-type wiper blade 22 in the cradle 90, the cradle recess depth is selected so as to locate the wiper blade 22 in sufficiently close proximity to the cover 36 when the cover 36 is closed such that the wiper blade 22 will not rotate in the compartment 32 and also will not otherwise come loose within the compartment 32.

At or adjacent at least one of the ends of the beam-type wiper blade receiving compartment is a beam-type wiper blade removal access undercut or offset 120 that is more deeply recessed than the cradle. Each such undercut or offset recessed region preferably extends all the way to the adjacent package edge thereby making it easier for a person wishing to remove a beam-type wiper blade seated in the cradle to do so. One or more fingers (not shown) are placed into the undercut or offset recessed region underneath an adjacent portion of the wiper blade 22 and lifted to pry the wiper blade 22 free from the cradle. As a result of this advantageous wiper blade access undercut or offset region, a purchaser or prospective purchaser can quickly and easily remove the wiper blade from the package.

To facilitate hanging the package 20 on a peg (not shown) such as what is typically used in in-store retail displays, at least one and preferably both package halves are equipped with an outwardly extending hanger tab 116 and 118 that each has a peg-receiving aperture 117 and 119, such as preferably a slot, extending completely through it. To accommodate accessories, such as additional adapters, wiping element cleaner, instructions, etc., the package base 30 preferably has a pair of spaced apart generally oblong accessory compartments 114 integrally formed therein. Preferably, each accessory compartment 114 is disposed adjacent one of the beam-type wiper blade removal access undercut or offsets 120.

When closed, the cover 36 can include a detent 140 (FIG. 3) formed in its outer sidewall 82 that releasably engages a lip or the like, such as part of lip 112, when the cover 36 is closed over the base 30.

If desired, a package 20 constructed in accordance with the present invention can be used by itself as a stand-alone package. However, if desired, such a package 20 can be employed as a package nest, such that it is received in another package. An example of another beam-type wiper blade package also capable of being used as a package nest is the package disclosed in presently copending and commonly owned U.S. Application Ser. No. 11/121,502, as published as U.S. Patent Application Publication No. US 2005/0252812 A1, the entire disclosure of which is hereby expressly incorporated by reference herein. Such an outer package in which the package 20 can be nested includes, for example, sleeves, cartons, tubes, or other types of packages that also can be of reclosable construction.

Figure 11:
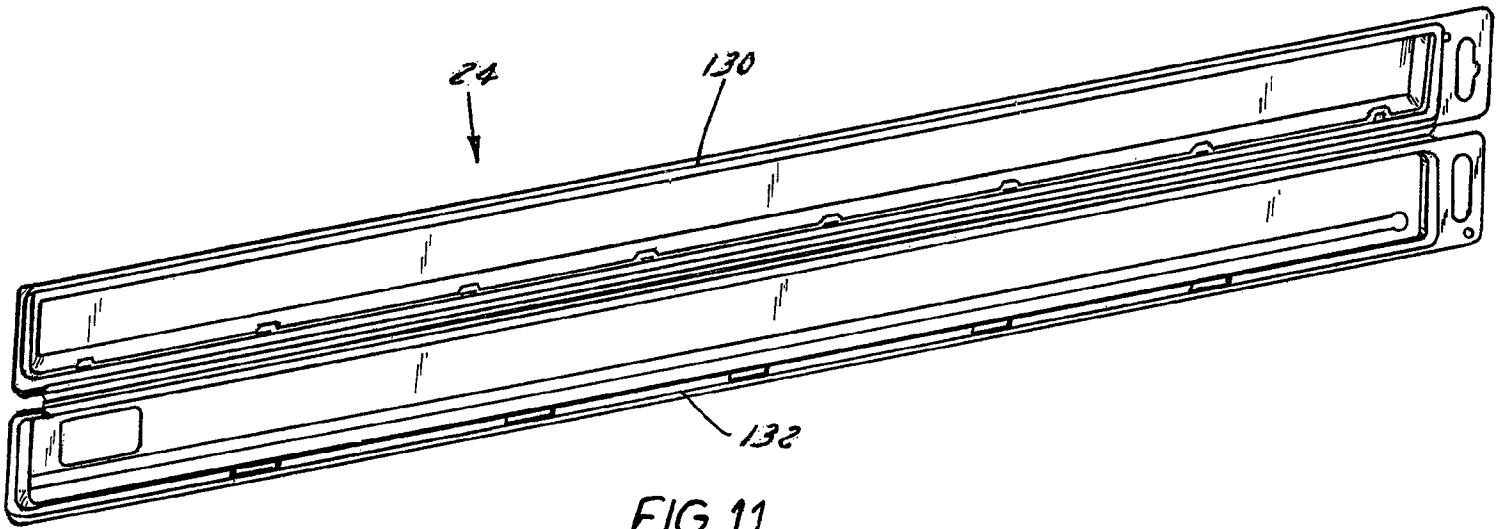
FIG. 11 is a perspective view of a reclosable clamshell outer package in which the beam type wiper blade package of FIGS. 1-10 is can be received.
Figure 12:
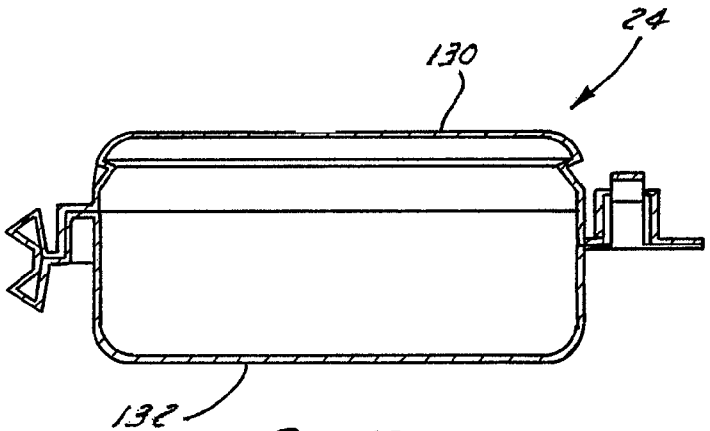
FIG. 12 is a cross section view of the clamshell package of FIG. 11 with the package shown closed.

FIGS. 11 and 12 illustrate a reclosable outer package 24 in one preferred application for the package 20 of the invention that is capable of removably receiving the package 20 of the present invention. The reclosable outer package 24 is of clamshell construction like that of package 20. The reclosable outer package 24 has a reclosable lid 130 that releasably engages a base 132 of the package 24 when the lid 130 is closed. Such an outer reclosable package is disclosed in commonly owned U.S. Pat. No. 5,899,334, the entire disclosure of which is hereby expressly incorporated by reference herein. Another such outer package in which the package 20 of the present invention can be nested is disclosed in commonly owned U.S. Pat. No. 6,070,723, the entire disclosure of which is hereby expressly incorporated by reference herein.

A package 20 constructed in accordance with the present invention releasably and reclosably holds a pre-curved beam-style wiper blade 22 having a length that is a plurality of pairs times its width at its widest section and having a width at its widest section that is a plurality of times its thickness or depth. For example, a package 20 constructed in accordance with the present invention is capable of holding a pre-curved beam style wiper blade 42 ranging in length anywhere between ten inches and thirty inches, has a package width no greater than about six inches, and preferably four inches or less, and has a package depth or thickness no greater than about one and one-half inches.

Such a package 20 can have such compact dimensions and be made of a relatively thin synthetic, polymeric or plastic material. For example, a preferred embodiment of the package 20 is formed of polyethylene terephalate (PET or PETE) having a wall thickness that can vary between eight mils and twenty mils but preferably ranges between ten mils and fifteen mils. If desired, another suitable material, such as polyvinyl chloride (PVC) can be used. Being able to retain the packaged beam-style wiper blade 22 in its pre-curved condition while protecting it, advantageously facilitates commercialization and consumer acceptance of these wiper blades, even despite the package 20 being made out of such thin material.

Where made of PET or PVC, the package 20 preferably is thermoformed of a single sheet preferably using, for example, a high speed inline pressure forming process or the like. The package 20 preferably is transparent but can be made opaque so as to be colored if desired. If desired, the package 20 can include indicia (not shown) molded or otherwise formed in it. Such indicia can also be imprinted on the package 20, if desired. The package 20 can also be configured to accommodate a card (not shown), such as a display card underlying part of the cover 36 or which is disposed interiorly within the base 30. A plurality of pairs of such packages 20 can be made substantially simultaneously from a common sheet 26 of material using such a manufacturing process.

A package 20 constructed in accordance with the present invention is easy to close, as the boss 70 of each snap is easily pressed into engagement with its corresponding snap receiver 72 when closing the package 20. The package 20 is just as easy to open as one as preferably both package halves 28 and 34 are grasped and pulled apart to disengage the boss 70 of each snap from its snap receiver 72.

In assembly, a beam-style wiper blade 22 is manipulated so as to insert one side edge of its beam into the seat formed in the package base. Thereafter, the cover 36 is folded over and brought toward the wiper blade 22 until the bosses 72 of the snaps begin seating in their respective receivers 72. Thereafter, the cover is moved closer to the base and, to the extent needed, additional force is applied to one or both package halves 28 and 34, including in the vicinity of one or more of the snaps 86, until each one of the bosses 70 releasably but positively engages its corresponding snap receiver 72.

It is also to be understood that, although the foregoing description and drawings describe and illustrate in detail one or more preferred embodiments of the present invention, to those skilled in the art to which the present invention relates, the present disclosure will suggest many modifications and constructions, as well as widely differing embodiments and applications without thereby departing from the spirit and scope of the invention.

It is claimed:

1. A wiper blade package in combination with a beam-type wiper blade comprising:

a pre-curved beam-type wiper blade comprised of a wiper arm mount, an elongate curved beam, and a wiping element extending outwardly from the curved beam having an outer tip and wherein the curved beam conforms the wiping element causing the wiping element to be curved without employing any articulating framework;

a reclosable wiper blade package formed of a single sheet of material and comprising a pair of generally rectangular, package panels joined by a hinge with a first package panel comprised of an elongate, and recessed wiper blade receiving cradle formed in a top wall that is three-dimensionally contoured along a width-wise direction comprised of a cradle bottom, a cradle sidewall extending downwardly relative to the top wall with the cradle sidewall comprising (a) a beam seat extending outwardly into the wiper blade receiving cradle having a flat portion against which part of the beam of the beam-type wiper blade bears against positioning the beam-type wiper blade within the wiper blade receiving cradle in a manner that prevents the tip of the wiping element of the beam-type wiper blade from contacting any portion of the first package panel, and (b) a second sidewall portion extending from the first sidewall portion generally at a right angle to the first sidewall portion with the second sidewall portion extending alongside the wiping element when the beam-type wiper blade element is received in the wiper blade receiving cradle, and a plurality of spaced apart wiper blade engaging protrusions, and a second package panel comprised of a cover that is releasably engageable with the first package panel;

wherein the beam-type wiper blade is releasably received in the wiper blade receiving cradle formed in the first package panel with the beam of the beam-type wiper blade bearing against the flat portion of the first sidewall of the beam seat positioning the wiping element within the wiper blade receiving chamber such that the tip of the wiping element cannot contact any portion of the first package panel and the beam-type wiper blade retained; and wherein at least one of the plurality of wiper blade engaging protrusions overlies part of the beam-type wiper blade received in the wiper blade receiving cradle on one side of the wiper arm mount and at least one other of the plurality of wiper blade engaging protrusions overlies another part of the beam-type wiper blade received in the wiper blade receiving cradle on the other side of the wiper arm mount.

2. The wiper blade package and beam-type wiper blade combination of claim 1, wherein the wiper blade receiving cradle extends substantially the length of the first package panel and is curved along a lengthwise extent of the first package panel.

3. The wiper blade package and beam-type wiper blade combination of claim 1 wherein the beam seat is elongate and extends longitudinally within the wiper blade receiving cradle.

4. The wiper blade package and beam-type wiper blade combination of claim 1 wherein the second wall has a flat land against which a portion of a side of the wiping clement rests when the beam-type wiper blade is received in the wiper blade receiving cradle.

5. The wiper blade package and beam-type wiper blade combination of claim 4 wherein the beam-type wiper blade received in the wiper blade receiving cradle is positioned on its side in the wiper blade receiving cradle.

6. The wiper blade package and beam-type wiper blade combination of claim 1 wherein each one of the plurality of wiper blade engaging protrusions have a portion that extends outwardly from the cradle sidewall into the wiper blade receiving cradle overlying part of the beam of the beam-type wiper blade received in the beam-type wiper blade receiving cradle.

7. The wiper blade package and beam-type wiper blade combination of claim 1 wherein there is a first plurality of wiper, blade engaging protrusions that extend outwardly into the wiper blade receiving cradle on one side of wiper arm mount of the beam-type wiper blade received in the wiper blade receiving cradle, and wherein there is a second plurality of wiper blade engaging protrusions that extend outwardly into the wiper blade receiving cradle on the other side of the wiper arm mount of the beam-type wiper blade received in the wiper blade receiving cradle.

8. The wiper blade package and beam-type wiper blade combination of claim 1 wherein each one of the wiper blade engaging protrusions comprises a locator tab that facilitates seating of the beam-type wiper blade in the wiper blade receiving cradle.

* * * * *